United States Patent [19]

Wasley et al.

[11] 3,932,125

[45] Jan. 13, 1976

[54] PREPARATION OF STRETCHABLE WOOL TEXTILES

[75] Inventors: William L. Wasley, Berkeley; Allen G. Pittman, El Cerrito, both of Calif.

[73] Assignee: The United States of America as represented by the Secretary of Agriculture, Washington, D.C.

[22] Filed: Jan. 24, 1974

[21] Appl. No.: 436,264

[52] U.S. Cl. ..... 8/128 R; 8/130.1; 428/270

[51] Int. Cl.[2] ..... D06M 3/02

[58] Field of Search ..... 8/128 R, 130.1, 127.5; 428/270

[56] References Cited

UNITED STATES PATENTS

| | | | |
|---|---|---|---|
| 2,400,377 | 5/1946 | Speakman | 8/128 R |
| 2,740,727 | 4/1956 | Littleton | 117/141 |
| 3,102,774 | 9/1963 | Koenig | 117/141 |
| 3,514,249 | 5/1970 | Bullington | 8/130.1 |
| 3,617,204 | 11/1971 | Pirie | 8/130.1 |

OTHER PUBLICATIONS

Chem. Abst., p. 5866, 1955.

*Primary Examiner*—Theodore Morris
*Attorney, Agent, or Firm*—M. Howard Silverstein; William Takacs; Max D. Hensley

[57] ABSTRACT

Wool textiles of enhanced stretch properties are prepared by contacting the textile with a hydroxylic liquid, i.e., ethylene glycol, propylene glycol, glycidol, glycerol, or diethylene glycol, under controlled conditions of time and temperature.

14 Claims, No Drawings

PREPARATION OF STRETCHABLE WOOL TEXTILES

DESCRIPTION OF THE INVENTION

This invention relates to and has among its objects the provision of novel processes for increasing the stretchability of wool textiles. Further objects of the invention will be evident from the following description wherein parts and percentages are by weight unless otherwise specified.

Wool is a very useful fiber and is employed in the fabrication of numerous articles. A major use of wool is in the production of wearing apparel. Although clothes made of wool have many desirable properties, they are sometimes avoided by the present-day consumer because they do not have sufficient stretch.

Methods are known in the art for imparting some degree of stretch to wool textiles. Typically, these methods rely on the use of reductive setting (with sodium bisulphite, or the like) of constrained yarns or fabric. Often such setting treatments are combined with special mechanical systems for compacting, crimping, or twisting the yarns as they are being set. Products prepared by these techniques are generally unstable to laundering and other treatments involving the application of aqueous media thereto. In addition, the known processes are expensive in that they require special machinery and increased labor and time.

The present invention provides a means for obviating the problems outlined above. A primary advantage of the invention is that it provides wool textiles of greatly enhanced stretchability. The invention has extensive utility and can be applied to all-wool textiles and to textiles which contain at least 25% wool, typically blends of wool with other natural or synthetic fibers such as cotton, linen, hemp, jute, ramie, sisal, cellulose acetate, cellulose acetate-butyrate, saponified acetate rayons, viscose rayons, cuprammonium rayons, ethyl cellulose, animal hair, polyurethane, polyacrylonitrile, polyesters such as polyethylene terephthalate, and the like. The term "wool-containing textile" is used herein as inclusive of all-wool textiles and wool blends which contain at least 25% wool. The textile material to which the invention is applied may be in the form of bulk fibers, yarns, sliver, roving, top, webbing, card, tape, or woven or knitted fabrics.

Another advantage is that the treatment of the invention does not cause any damage to the intrinsic properties of the textile. Thus it does not decrease such vital attributes as hand and abrasion resistance. As a consequence, the treated textiles are suitable for all conventional uses of textiles as in fabrication of suits, shirts, skirts, and garments of all kinds. It is further to be noted that the process of the invention is outstanding in its simplicity and can be carried out with conventional equipment to be found in any textile-treating plant. Moreover, the process of the invention yields stretchable products from fabrics which are of conventional construction. In other words, the fabrics used as starting materials in the process of the invention are conventional woven or knitted ones.

Another advantage of the invention is that the imparted stretchability is essentially permanent. Thus the result obtained by the process of the invention is retained where the treated textile is subjected to repeated dry cleaning and even repeated aqueous laundering.

Another advantage of the invention is that the hereindescribed procedure may be used in conjunction with conventional textile-finishing techniques—such as dyeing, shrinkproofing, setting, and the like—without interfering with the results attained by such finishing treatments. In fact, enhanced results are often attained as explained below.

An additional advantage of the invention is that the treated textiles are more easily dyed in that they have enhanced dye-receptivity. Moreover, the treated fibers can be dyed by conventional dyes and the imparted colors are essentially permanent and not removed by laundering.

Another advantage of the invention is that the treated textiles exhibit an increased ability to take a set, that is, they have increased settability. Thus, for example, creases that are steamed into the treated textiles are more durable and long-lasting than with the untreated textiles. Moreover, such creases, pleats, or other configurations provided to the treated textiles are retained even after aqueous laundering. Moreover, if the treated textiles are subjected to conventional setting—as with a bisulphite—they are more resistant to wrinkling and mussing when subjected to wear and to aqueous laundering than is the case where flat setting is applied to the untreated textile.

The objects of the invention are attained by contacting the wool textile, under particular conditions, with any one of certain hydroxylic liquids, namely, ethylene glycol, glycidol, propylene glycol, glycerol, or diethylene glycol. The conditions of the treatment have been found to be critical and the desired results are attained by a correlation of time and temperature for each particular liquid.

In the case of treatment with ethylene glycol or glycidol, the temperature of treatment may range from 120° to 180° C., and the time of treatment is governed by the equation -

$$T = 175 \pm 10 - 16.7 \log t \qquad (I)$$

wherein T is the temperature in degrees Centigrade, and t is the time in seconds.

By operating within the limits of Equation I, the desired results of the invention are realized. Most importantly, a great increase in stretchability is achieved. In typical cases where the starting material is an all-wool woven fabric, there is obtained an 8-fold increase in stretchability in the warp direction and a 2-fold increase in stretchability in the fill direction. Moreover, by operating under such conditions, there is little or no discoloration of the textile, it suffers little or no loss of tensile strength, and it retains its original hand. Typical examples of operating conditions within the limits of Equation I are given below by way of illustration:

| Temp., °C | Time, sec. |
|---|---|
| 140 | 31 to 495, preferably 260 |
| 150 | 8 to 124, preferably 30 to 60 |
| 160 | 2 to 31, preferably 16 |

Our researches have shown that both under- and over-treatment are undesirable since they do not attain the results of the invention. For example, if the process is carried out at a selected temperature within the specified range but for a time less than that calculable from Equation I, the product has poor stretchability. If the time is increased above that calculable from the equation, inferior results are also obtained. These include discoloration, weakening of the fibers, and deterioration of hand so that in aggravated cases the product is rubbery when wet but boardy and brittle when dry.

In the case of treatment with propylene glycol, glycerol, or diethylene glycol, the temperature may range from 140 to 180° C., and the time of treatment is governed by the equation - $T = 188 \pm 8 - 16.7 \log t$ (II) wherein T is the temperature in degrees Centigrade, and t is the time in seconds.

In the same way as explained above, if the treatment is carried out at times or temperatures below or above those governed by Equation II, inferior results are obtained. Typical examples of operating conditions within the limits of Equation II are given below by way of illustration:

| Temp., °C | Time, sec. |
|---|---|
| 150 | 63 to 562, preferably 300 |
| 160 | 16 to 142, preferably 130 |
| 170 | 4 to 34, preferably 20 |

Contact between the hydroxylic liquid and the textile to be treated can be accomplished in various ways. The simplest and preferred method is to immerse the textile in a heated bath of the hydroxylic liquid. After the period of time necessary to produce the benefits of the invention, the textile is removed and immediately cooled to below 100° C.—usually to about room temperature—in order to quench (arrest) the reaction.

In an alternative procedure, the treatment with the hydroxylic liquid is carried out as follows: The textile is impregnated with the selected hydroxylic liquid and then passed through an oven or other heating chamber wherein it is brought to the desired temperature and held thereat for the appropriate time. The treated textile is then removed from the oven, and immediately cooled.

Other methods for effecting contact between the hydroxylic liquid and the textile will be obvious to those skilled in the art. It should be noted that the process of the invention is readily adapted to continuous or batch procedures, whichever is desired.

The cooling operation can be carried out in various ways. For example, the treated textile can be immersed in cold (tap) water, or in water which is cooled by addition of ice or by the use of refrigerated coils, or the like. Alternatively, the treated textile can be cooled by passing it between chilled rollers, or it can be subjected to a blast of cold air or a spray of cold water or carbon dioxide snow. Another plan is to cool the treated textile by contact with a chilled non-aqueous inert liquid such as trichloroethane, perchloroethane, hexane, or a fluorocarbon such as difluorodichloromethane.

After cooling, the textile is treated to remove any hydroxylic liquid which remains on it. Since the hydroxylic liquids are soluble in water, this is most readily accomplished by washing with water. Alternatively, the residual hydroxylic liquid is removed by washing with a non-aqueous, volatile, inert solvent such as methanol, ethanol, trichloroethane, perchloroethylene, and the like.

After removal of residual hydroxylic liquid, the treated textile is dried in conventional manner and is then ready for use or sale.

In an alternative modification of the invention, a minor amount (about 0.01 to 0.5%) of an acid is added to the hydroxylic liquid prior to contact with the wool textile, whereby to minimize possibility of discoloration of the textile. For this purpose one can use acids such as p-toluene sulphonic acid, benzene sulphonic acid, sulphuric acid, sulphamic acid, phosphoric acid, hydrochloric acid, ascorbic acid, etc. Preferably, p-toluene sulphonic acid is used in a concentration of about 0.2%.

EXAMPLES

The invention is further demonstrated by the following examples provided by way of illustration and not limitation.

The tests referred to in the examples were carried out as follows:

Stretchability: Strips of fabric, 1 inch in width and 10 inches long, were stretched in an Instron tester under a force of 2 lbs. The elongation of the strip resulting therefrom was measured and from this the percent stretch was calculated.

Abrasion resistance: The Stoll flex abrasion test described in ASTM-D 1175-71 was employed. Resistance to flexing and abrasion is measured by subjecting the specimen to unidirectional reciprocal folding and rubbing over a bar having specified characteristics, under known conditions of pressure and tension. The results are expressed as the number of cycles required to break the specimen.

Breaking strength: Carried out according to ASTM-D 1682-64. A continuously increasing load is applied to a one-inch wide sample of the fabric and the test is carried to rupture, at which time the force is measured.

EXAMPLE 1

I. Various fabrics (identified below) were each treated as follows: The fabric was immersed in a bath of ethylene glycol at 150° C. for 30 seconds, then removed and immediately quenched in a bath of cold water. The fabric was then washed in warm water and dried.

The resulting products and samples of the untreated fabrics were then tested for stretch, abrasion, resistance, and breaking strength.

The fabrics to which the procedure was applied were as follows:

A. Worsted wool, undyed, 6 oz./sq. yd.
B. Worsted wool, dyed brown, 6.3 oz./sq. yd.
C. 90:10 blend of wool and polyester, dyed brown, 4.22 oz./sq. yd.
D. 80:20 blend of wool and polyester, dyed brown, 6.76 oz./sq. yd.
E. 60:40 blend of wool and polyester, dyed gold, 6.9 oz./sq. yd.

It was observed that in all cases the hand of the treated fabrics was identical with that of the untreated fabrics.

The results of the various tests are summarized below.

| Sample | Fiber* | Stretch, % Warp | Stretch, % Fill | Abrasion resistance cycles to break Warp | Abrasion resistance cycles to break Fill | Breaking strength, % Warp | Breaking strength, % Fill |
|---|---|---|---|---|---|---|---|
| A (treated) | W | 15.8 | 14.5 | 3494 | 4140 | 45.2 | 30.7 |
| A (untreated) | W | 2.0 | 9.0 | 2681 | 2474 | 50.1 | 31.6 |
| B (treated) | W | 10.5 | 11.9 | 1600 | 1458 | 43.4 | 29.6 |
| B (untreated) | W | 3.2 | 6.2 | 978 | 950 | 45.9 | 32.7 |
| C (treated) | W/PE, 90/10 | 12.0 | — | — | 1692 | 35.3 | — |
| C (untreated) | W/PE, 90/10 | 2.6 | — | 2245 | 1674 | 38.2 | 24.8 |
| D (treated) | W/PE, 80/20 | 15.0 | 12.4 | 3690 | 3350 | 57.4 | 46.1 |
| D (untreated) | W/PE, 80/20 | 3.6 | 11.7 | 2830 | 2868 | 65.7 | 43.4 |
| E (treated) | W/PE, 60/40 | 12.5 | 11.7 | 2760 | 3099 | 67.6 | 53.4 |
| E (untreated) | W/PE, 60/40 | 2.6 | 10.7 | 2567 | 2666 | 82.2 | 52.6 |

* W = wool
PE = polyester

EXAMPLE 2

Samples of undyed worsted wool fabric were immersed in a bath of ethylene glycol at various times and temperatures (as given below) and the samples were then immediately quenched in cold water, washed, and dried.

The stretchability of the fabrics was measured before and after treatment, and the results are tabulated below.

| Sample | Treatment conditions Temperature °C. | Time sec. | Stretch (warp) % |
|---|---|---|---|
| 1 | 160 | 10 | 10.4 |
| 2 | 150 | 30 | 9.5 |
| 3 | 150 | 60 | 8.8 |
| 4 | 140 | 60 | 5.0 |
| 5 | 140 | 180 | 10.8 |
| 6 | 130 | 300 | 7.9 |
| 7 | 130 | 600 | 10.2 |
| Control | — | — | 2.9 |

EXAMPLE 3

A lot of undyed worsted wool fabric was divided into a series of samples. A series of these were treated as described in Example 1, Part I. The treated fabric had a stretchability of 16% (warp), 15% (fill) compared to 2% (warp) and 9% (fill) for the untreated fabric.

Samples of the treated and untreated fabric were then tested for dyeability by dyeing them in conventional manner with various types of dyes as set forth below, each applied at 2% in the dyebath.

Chrome dyes:
- Chrome fast yellow ME (C.I. mordant yellow 30)
- Chrome fast blue RLL (C.I. mordant blue 12)

Neutral pre-metallized dyes:
- Supralan blue NB (C.I. acid blue 179)
- Supralan red NB (C.I. acid red 182)
- Supralan yellow NR (C.I. acid yellow 121)

Acid pre-metallized dyes:
- Neolan blue 2R (C.I. acid blue 154)
- Calcofast yellow N (C.I. acid yellow 54)
- Calcofast pink N (C.I. acid red 186)

Acid leveling dyes:
- Lanasyn brilliant red RL (C.I. acid red 263)
- Alizarine sky blue 5GLW (C.I. acid blue 232)

Fiber-reactive dyes:
- Lanasol red G (C.I. reactive red 83)
- Lanasol red 5B (C.I. reactive red 66)

It was observed that satisfactory dyeings were obtained with the treated fabric. Indeed, with the treated fabric the color developed at a much faster rate than with the untreated fabric. In addition, the treated samples attained deeper colors than did the untreated samples.

EXAMPLE 4

The fabric used in these tests was brown-dyed worsted wool cloth, 6.3 oz./sq. yd.

A. Samples of the fabric were treated as described in Example 1, Part I.

B. Samples of the fabric were given a conventional shrinkproofing treatment. To this end there was applied 1% (based on the weight of fabric) of a commercially-available polyurethane containing free isocyanate groups, prepared by reaction of a triol with hexamethylene diisocyanate, having a molecular weight of about 3,000 and containing about 3.5 to 4.0% free NCO. The so-treated fabric was then treated as described in Example 1, Part I.

The treated samples and samples of the untreated (original) fabric were then washed in conventional manner in a top-loading, agitator-type household washer five times. After each washing, the samples were tumble-dried. Shrinkage was determined after the 3rd and 5th washings and dryings. The results are tabulated below.

| Sample | Treatment Shrink-proofing | Treatment Ethylene glycol | Area shrinkage, % 3rd wash | Area shrinkage, % 5th wash |
|---|---|---|---|---|
| Untreated control | No | No | 15 | 24 |
| A | No | Yes | 10 | 16 |
| B | Yes | Yes | 0 | 1 |

EXAMPLE 5

Small tabs were attached to single wool fibers at each end, using a small amount of adhesive. The fibers were wetted with water and stretched so that their length increased by 14% as determined on an Instron tester. The amount of stress necessary to achieve this elongation was measured.

The fibers were dried and treated by immersing in hot (150°C.) ethylene glycol containing 0.2% of p-toluene sulphonic acid for various times (5,10,20, and 30 sec.). The fibers were then quenched in cold water and washed.

The wet treated fibers were then subjected to the above test to determine the stress necessary to stretch the fibers by 14%. From these figures there was calculated the decrease in stress required to attain the 14% elongation. The results are tabulated below.

| Sample | Time of treatment, sec. | Percent decrease in stress necessary to extend fibers 14% (wet) |
|---|---|---|
| A | 5 | 6.5 |
| B | 10 | 13 |
| C | 20 | 17 |
| D | 30 | 26 |

The experiments on single fibers were repeated, but this time the elongation properties of the fibers were measured on the dry fibers, before and after treatment. The results are given below.

| Sample | Time of treat-ment, sec. | Elongation to break, % (dry) | Stress to break gms/tex. (dry) | Percent decrease in stress to extend fiber 14%, (dry) |
|---|---|---|---|---|
| E | 5 | 44.3 | 12.2 | 7.1 |
| F | 20 | 43.2 | 12.3 | 15.4 |
| G | 30 | 38.8 | 9.3 | 17.8 |
| Untreated control | — | 30.7 | 10.4 | — |

EXAMPLE 6

Samples of undyed worsted wool fabric were treated as in Example 1, Part I, except that 0.2% of p-toluene sulphonic acid was added to the ethylene glycol prior to the treatment.

The treated, dried samples were shrinkproofed with the same commercially-available polyurethane as described in Example 4. To this end the fabrics were immersed in a 2% solution of the polyurethane in methyl chloroform. Following immersion, the samples were passed through squeeze rolls to a wet pick-up of 60% and then air dried. The so-treated samples were cured by steaming in a tailor's press for 3 minutes. For comparative purposes, samples of the untreated fabric were also subjected to the shrinkproofing operation.

All the samples were then given a flat setting as follows: The samples were immersed in an aqueous 2% solution of sodium bisulphite (conventional setting agent) and passed through squeeze rolls to obtain a 60% wet pick-up. The damp samples were arranged flat on a tailor's press and steamed for 2 minutes.

All the samples were then subjected to 5 cycles of washing and drying, each washing being in a household-type washer and each washing being followed by tumble-drying.

After each cycle of washing (and drying), the samples were evaluated for fabric smoothness and crease retention, using the following tests:

Fabric smoothness: Determined by AATCC method 88A-III-C which employs an overhead lighting procedure. Higher values in this test indicate a greater degree of smoothness.

Crease retention: Measured by AATCC method 88C-III-C. Higher values in this test indicate greater crease retention.

The results are summarized below.

| No. of washings | Smoothness Untreated | Smoothness Treated | Crease retention Untreated | Crease retention Treated |
|---|---|---|---|---|
| 1 | 2.5 | 2.5 | 2.0 | 4.0 |
| 2 | 2.0 | 3.0 | 1.0 | 3.5 |
| 5 | 2.0 | 3.0 | 1.0 | 3.0 |

EXAMPLE 7

A 6 inch × 11 inch sample of 80:20 wool:polyester blend fabric was immersed in ethylene glycol at 145° C. for 60 sec., then quenched in cold water, washed in warm water, and dried.

The treated sample from above and an untreated (6 inch × 11 inch) sample were steam-pressed until smooth and then were conditioned for 24 hours in a chamber held at 85° F. and 85% Relative Humidity (RH). Afterwards, the samples were wrinkled with a 500-gm. weight for 5 minutes on an AATCC wrinkle tester. The samples were removed and were allowed to freely hang in a room held at 70° F. and 65% RH.

Wrinkle resistance and wrinkle recovery were determined by the AATCC - 128 test. The degree of wrinkling was assessed visually by comparison with a series of photographs graded as follows: Most wrinkled - 1, least wrinkled - 5. Grading was carried out by three trained technicians at time intervals of 5 min., 1 hour, and 24 hours.

The results are tabulated below.

| Sample | Wrinkle rating (average) 5 min. | 1 hr. | 24 hrs. |
|---|---|---|---|
| Treated | 2.3 | 3.0 | 4.5 |
| Untreated (control) | 1.5 | 2.0 | 3.2 |

EXAMPLE 8

A lot of undyed worsted wool fabric was divided into a series of samples. These samples were each contacted under selected time and temperature (as given below) with a particular liquid. The liquids used included glycidol, propylene glycol, glycerol, and diethylene glycol. In each liquid, 0.2% p-toluene sulphonic acid was included. Following contact with the liquid, the fabrics were immediately quenched in cold water, washed to remove occluded liquid, and dried.

The products were examined for color and hand, and tested for stretchability. In all cases, there was no discoloration and the products retained their original hand.

The results of the stretch tests are tabulated below.

| Hydroxylic liquid | Treatment conditions Temp., °C | Time, sec. | Stretch (warp) % |
|---|---|---|---|
| Glycidol | 150 | 30 | 11.0 |
| Propylene glycol | 160 | 30 | 8.0 |
| Glycerol | 150 | 60 | 7.0 |
| Glycerol | 160 | 60 | 10.3 |
| Diethylene glycol | 150 | 60 | 6.0 |
| Untreated control | — | — | 3.0 |

Having thus described our invention, we claim:

1. A process for enhancing the stretchability of a wool-containing textile, which consists of a. immersing the textile in a bath consisting of ethylene glycol at a temperature in the range 120° and 180° C. and for a time governed by the limits of the equation $T = 175 \pm 10 - 16.7 \log t$ wherein T is the temperature in degrees Centigrade, and t is the time in seconds, b. immediately arresting the treatment by cooling the textile, c. washing the textile to remove residual ethylene glycol, and drying the textile.

2. The process of claim 1 wherein the bath consists of ethylene glycol and about 0.2% of p-toluene sulphonic acid.

3. A process for enhancing the stretchability of a wool-containing textile, which consists of a. immersing the textile in a bath consisting of ethylene glycol at a temperature in the range 120° to 180° C. and for a time governed by the limits of the equation $T = 175 \pm 10 - 16.7 \log t$ wherein T is the temperature in degrees Centigrade and t is the time in seconds, b. immediately quenching the so-treated textile in cold water, c. washing it with water, and drying it.

4. The process of claim 3 wherein the bath consists of ethylene glycol and about 0.2% p-toluene sulphonic acid.

5. A process for enhancing the stretchability of a woven wool-containing textile, which consists of a. immersing the textile in a bath consisting of ethylene glycol at a temperature of about 150° C. for a period of about 30 to 60 seconds.

b. immediately quenching the so-treated textile in cold water, c. washing it with water, and drying it.

6. The process of claim 5 wherein the bath consists of ethylene glycol and about 0.2% p-toluene sulphonic acid.

7. A process for enhancing the stretchability of a wool-containing textile, which consists of a. immersing the textile in a bath consisting of glycidol at a temperature in the range 120° to 180° C. and for a time governed by the limits of the equation $T = 175 \pm 10 - 16.7 \log t$ wherein T is the temperature in degrees Centigrade, and t is the time in seconds, b. immediately arresting the treatment by cooling the textile, c. washing the textile to remove residual glycidol, and drying the textile.

8. The process of claim 7 wherein the bath consists of glycidol and about 0.2% p-toluene sulphonic acid.

9. A process for enhancing the stretchability of a wool-containing textile, which consists of a. immersing the textile in a bath consisting of propylene glycol at a temperature in the range 140° to 180° C. and for a time governed by the limits of the equation $T = 188 \pm 8 - 16.7 \log t$ wherein T is the temperature in degrees Centigrade, and t is the time in seconds, b. immediately arresting the treatment by cooling the textile, c. washing the textile to remove residual propylene glycol, and drying the textile.

10. The process of claim 9 wherein the bath consists of propylene glycol and about 0.2% p-toluene sulphonic acid.

11. A process for enhancing the stretchability of a wool-containing textile, which consists of a. immersing the textile in a bath consisting of glycerol at a temperature in the range 140° to 180° C. and for a time governed by the limits of the equation $T = 188 \pm 8 - 16.7 \log t$ wherein T is the temperature in degrees Centigrade, and t is the time in seconds, b. immediately arresting the treatment by cooling the textile, c. washing the textile to remove residual glycerol, and drying the textile.

12. The process of claim 11 wherein the bath consists of glycerol and about 0.2% toluene sulphonic acid.

13. A process for enhancing the stretchability of a wool-containing textile, which consists of a. immersing the textile in a bath consisting of diethylene glycol at a temperature in the range 140° to 180° C and for a time governed by the limits of the equation $T = 188 \pm 8 - 16.7 \log t$ wherein T is the temperature in degrees Centigrade, and t is the time in seconds, b. immediately arresting the treatment by cooling the textile, c. washing the textile to remove residual diethylene glycol, and drying the textile.

14. The process of claim 13 wherein the bath consists of diethylene glycol and about 0.2% p-toluene sulphonic acid.

* * * * *